US006698651B1

(12) United States Patent
Green

(10) Patent No.: US 6,698,651 B1
(45) Date of Patent: Mar. 2, 2004

(54) SLIDABLE TRAY MAILBOX INSERT

(76) Inventor: Jack R Green, 4428 Hickory Grove Rd., Mt. Holly, NC (US) 28120

( * ) Notice: Subject to any disclaimer, the term of this patent is extended or adjusted under 35 U.S.C. 154(b) by 0 days.

(21) Appl. No.: 10/109,924

(22) Filed: Mar. 29, 2002

(51) Int. Cl.[7] ..... B65D 91/00
(52) U.S. Cl. ..... 232/29; 232/17; 232/33
(58) Field of Search ..... 232/33, 29, 17; 220/23.87, 23.89; 312/334.1, 334.7

(56) References Cited

U.S. PATENT DOCUMENTS

| | | | | | |
|---|---|---|---|---|---|
| 838,194 | A | * | 12/1906 | Larsh | 232/17 |
| 1,139,491 | A | * | 5/1915 | Coon | 232/39 |
| 1,848,995 | A | * | 3/1932 | Coleman | 232/33 |
| 2,760,721 | A | * | 8/1956 | Roberts | 232/33 |
| 3,606,140 | A | * | 9/1971 | Shannahan | 232/17 |
| 4,600,143 | A | * | 7/1986 | Harlow et al. | 232/17 |
| 4,753,385 | A | * | 6/1988 | Phipps et al. | 232/17 |
| 4,848,650 | A | * | 7/1989 | Roberts, II | 232/17 |
| 4,896,827 | A | * | 1/1990 | Economou | 232/17 |
| 4,932,587 | A | * | 6/1990 | Robbins | 232/17 |
| 4,934,592 | A | * | 6/1990 | DiMenichi | 232/17 |
| 5,009,366 | A | | 4/1991 | van Druff, Jr. et al. | |
| 5,083,703 | A | * | 1/1992 | Blyakharov | 232/17 |
| 5,271,555 | A | * | 12/1993 | Mayer | 232/17 |
| 5,425,501 | A | | 6/1995 | Wesorick | |
| 5,765,749 | A | | 6/1998 | Harper | |
| 5,775,578 | A | | 7/1998 | Baxi et al. | |

* cited by examiner

*Primary Examiner*—William L. Miller
(74) *Attorney, Agent, or Firm*—Michael I. Kroll

(57) ABSTRACT

A tray and track assembly for a typical rural mailbox has a track frame attached to the mailbox bottom with longitudinal rails for receiving and guiding a pair of track members on the bottom of a tray. Two extension arms are pivotally attached to the sidewalls of the tray, and attached to the inside of the hinged mailbox front door. When the front door is opened the extension arms pull the tray forward on the track frame until stop members on the track frame and tray halt the forward movement of the tray. A part of the tray is then beyond the interior of the mailbox. The extension arms push the tray back into the mailbox when the front door is closed. Ridges elevate the mail above condensation that forms on the tray bottom, and drain holes in the tray allow such liquids to drain.

18 Claims, 13 Drawing Sheets

SLIDABLE TRAY MAILBOX INSERT

BACKGROUND OF THE INVENTION

1. Field of the Invention

The present invention relates generally to mailboxes and, more specifically, to a slidable tray device for roadside mailboxes that extends from within the mailbox as the mailbox door is opened and retracts as the door is closed.

2. Description of the Prior Art

There are other slidable trays designed for mailboxes. Typical of these is U.S. Pat. No. 5,009,366 issued to Albert van Druff, Jr. et al. on Apr. 23, 1991.

Another patent was issued to Michael J. Wesorick on Jun. 20, 1995 as U.S. Pat. No. 5,425,501. Yet another U.S. Pat. No. 5,765,749 was issued to Karl Harper. on Jun. 16, 1998 and still yet another was issued on Jul. 7, 1998 to Rupert P. Baxi et al. as U.S. Pat. No. 5,775,578.

U.S. Pat. No. Des. 5,009,366

Inventor: Albert van Druff, Jr. et al.

Issued: Apr. 23 1991

A tray-type mailbox insert for use in delivering and removing mail from a mailbox formed of a foldable blank including a bottom panel, side panels, and an end panel and having locking panels and locking tabs to secure the insert in a tray-like configuration.

U.S. Pat. No. 5,125,501

Inventor: Michael J. Wesorick

Issued: Jun. 20, 1995

The present invention relates to an improved sliding hooded mail carrier tray for a conventional rural mailbox structure. The rural type mailbox has a rectangular bottom panel, a back panel extending from one end of the rectangular bottom panel, a U-shaped roof portion extending from opposite sides of the bottom panel and a swinging pivotal door at another end. The improvement consists of a transparent hooded mail carrier having a slightly smaller cross sectional configuration compared to a cross-sectional configuration of the mailbox. The hooded mail carrier comprises a rectangular bottom wall, a back wall extending from the back end of the rectangular bottom wall and a U-shaped hood portion extending from opposite sides of the rectangular bottom wall defining an enclosure with the front end of the hooded mail carrier having an opening for receipt of mail. The hooded mail carrier also has upper rails on opposite sides thereof mounted on the outside of the U-shaped hood portion and lower rollers positioned on a rear portion of the hooded mail carrier beneath the upper rails. The upper rails of the hooded mail carrier are cooperable with upper mailbox rollers attachable at opposite sides of an inside wall of the mailbox and the lower rollers of the hooded mail carrier are cooperable with lower mailbox rails attachable at opposite sides of an inside wall of the mailbox in order for the hooded mail carrier to slide smoothly in horizontal telescoping engagement in and out of the mailbox. A stop lever is mounted on an inside wall of the mailbox for coaction with the upper rails to ensure that the hooded mail carrier does not come all the way out from the mailbox wherein any mail can be easily inserted and retrieved protecting the mail from weather elements when the hooded mail carrier is extended from the mailbox. When the hooded mail carrier is fully inserted into the mailbox, then the mailbox can be closed with the hooded mail carrier enclosed within the mailbox.

U.S. Pat. No. 5,765,749

Inventor: Karl Harper

Issued: Jun. 16, 1998

A mailbox insert structure positionable within a mailbox for aiding in the removal of mail from the mailbox, having a floor portion, a back wall portion, a pair of opposite sidewall portions, generally open front and top portions, a finger engagement portion positioned near the front of the floor portion and which is engagable for pulling the insert structure outwardly through the mailbox door opening so that mail can be removed from the insert structure through the open front and top portions of the insert, retainers positioned proximate the rear portion of the insert structure. A forwardly extending portion of the floor portion extends forwardly from the sidewalls, and includes angled side portions which abut the edges of the mailbox door for directing the insert structure outwardly through the mailbox door U.S. Pat. No. 5,775,578

Inventor: Rupen P. Baxi, et al.

Issued: Jul. 7, 1998

A rural mailbox hooded retractable tray insert molded from a plastic material having flexural ability. The mailbox hooded tray insert having a finger grip for in and out movement of the tray and a slider groove along the hood length that guides and limits the in and out movement. The tray insert hood prevents mail from falling out during tray movement and contains storage space for bee and insect repellent. The tray insert back wall has a vertical member having a flexible hinge for moving the tray insert partially out of the mailbox to expose the finger grip when the mailbox is opened.

While these mailbox tray devices may be suitable for the purposes for which they were designed, they would not be as suitable for the purposes of the present invention, as hereinafter described.

SUMMARY OF THE PRESENT INVENTION

The present invention relates generally to mailbox inserts and, more specifically, to a slidable tray mailbox insert that extends from the mailbox as the mailbox door is opened and returns when the mailbox door is closed due to a mechanical means that communicates between the slidable tray and the mailbox door.

A primary object of the present invention is to provide a slidable tray mailbox insert comprising: a slidable tray having two extension arms pivotably attached to opposing tray sidewalls with the distal ends of each extension arm having a pivotably connected footpad with attachment means and with the tray sidewall further having track member recesses extending longitudinally; a relatively flat track framework having a base portion with two horizontal, longitudinal rails elevated therefrom and said framework further having an underside with an attachment means located thereon.

Another object of the present invention is to provide a slidable tray mailbox insert wherein the attachment means on the footpads and on the underside of the track frame base could include but are not limited to double-sided peel and stick tape, hook and loop fasteners with peel and stick tape, magnets, et cetera, with double-sided peel and stick tape being the preferred attachment means.

Still another object of the present invention is to provide a slidable tray mailbox insert that could be retrofitted to most conventional roadside mailboxes within minutes without the use of tools. Installation is as simple as removing the protective covering from the peel and stick tape on the underside of the track framework and securing the framework to the floor of the mailbox. The tray track members are then aligned to accommodate the horizontal rails of the track framework as the tray is slid into the fully operational position. The protective coverings of the peel and stick tape on the footpads are then removed and the footpads are secured to the inside of the open mailbox door. Shut the mailbox door and the tray will retract along the rails of the track framework into the mailbox, when the door is opened the tray will extend therefrom. The present invention is fully installed and ready to use.

A further object of the present invention is to provide a slidable tray mailbox insert that will allow the user to visually inspect and remove the contents of a mailbox while standing beside it without having to reach blindly therein. This will enable the user to avoid the potentially hazardous situation of standing in the street in front of the mailbox.

A yet further object of the present invention is to provide a slidable tray mailbox insert including a stop mechanism on the slidable tray and the track framework that would allow for installation while restricting the slidable tray from extending beyond a predetermined location.

Another object of the present invention is to provide a slidable tray mailbox insert wherein the floor of the slidable tray has drainage recesses to prevent the accumulation of fluid that may be introduced into the mail containment area.

Yet another object of the present invention is to provide a slidable tray mailbox insert wherein the floor of the slidable tray has raised condensation ridges to protect mail from resting flat on the floor when condensation develops thereon and to provide for better fluid drainage when necessary.

Still another object of the present invention is to provide a slidable tray mailbox insert that is simple and easy to use.

One other object of the present invention is to provide a slidable tray mailbox insert that is economical in cost to manufacture.

Additional objects of the present invention will appear as the description proceeds.

Another object is to provide a mailbox tray that will make it easier for a mailman to place mail inside the box, as a result of the tray being closer to the vehicle than the mouth of the mailbox.

Still another object is to provide a mailbox tray that can be integrated into newly manufactured mailboxes or retrofitted to existing conventional mailboxes.

A device is provided for accessing mail within a mailbox, the mailbox having a bottom panel, back panel, roof portion, and a pivoting front door, the device comprising: a tray, the tray having a bottom portion, a pair of opposite sidewall portions, a back portion, and a track member; a pair of extension arms, each arm having a first end pivotally attached to one of the tray sidewalls, and a second end pivotally attached to the mailbox front door; and a track, the track being attached to the mailbox, the track being adapted to receive the tray track member such that the tray is slidable along the track, the tray being pulled along the track and at least partially out of the mailbox when the mailbox door is opened, the tray being pushed along the track and back within the mailbox when the mailbox door is closed.

In another embodiment, the number of tray track members is two.

In another embodiment, each of the track members has an outwardly extending horizontal portion, and the track has two inwardly facing slots for receiving the track member horizontal portions.

In another embodiment, the track has an abutment member and the tray has an abutment member, the two abutment members being brought to an encounter as the tray is pulled from the mailbox, thus stopping the tray from being pulled further along the track.

In another embodiment, the tray back portion is closely received by the mailbox roof portion as the tray is pushed into the mailbox.

In another embodiment, the mailbox roof portion is U-shaped and the tray back portion is U-shaped for close receipt by the mailbox roof portion.

In another embodiment, the tray bottom portion further comprises at least two elevated ridges.

In another embodiment, the tray bottom portion further comprises at least one drain hole.

In another embodiment, the track is attached to the mailbox using adhesives.

In another embodiment, the track is attached to the mailbox using hook and loop strips.

In another embodiment, the track is attached to the mailbox using adhesive strips.

In another embodiment, the track is attached to the mailbox using magnets.

In another embodiment, the track is attached to the mailbox using screws.

In another embodiment, the track is attached to the mailbox using bolts.

In another embodiment, the extension arm first ends are attached to the mailbox front door using adhesives.

In another embodiment, the extension arm first ends are attached to the mailbox front door using hook and loop strips.

In another embodiment, the extension arm first ends are attached to the mailbox front door using adhesive strips.

In another embodiment, the extension arm first ends are attached to the mailbox front door using magnets.

In another embodiment, the extension arm first ends are attached to the mailbox front door using screws.

In another embodiment, the extension arm first ends are attached to the mailbox front door using bolts.

There is provided a device for accessing mail within a mailbox, the mailbox having a bottom panel, back panel, roof portion, and a pivoting front door, the device comprising: a tray, the tray having a bottom portion, a pair of opposite sidewall portions, a back portion, and a track member; a track, the track being attached to the mailbox, the track being adapted to receive the tray track member such that the tray is slidable along the track, the tray being pulled along the track and at least partially out of the mailbox when the mailbox door is opened, the tray being pushed along the track and back within the mailbox when the mailbox door is closed; and means for pulling the tray at least partially out of the mailbox in response to the mailbox front door being opened.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
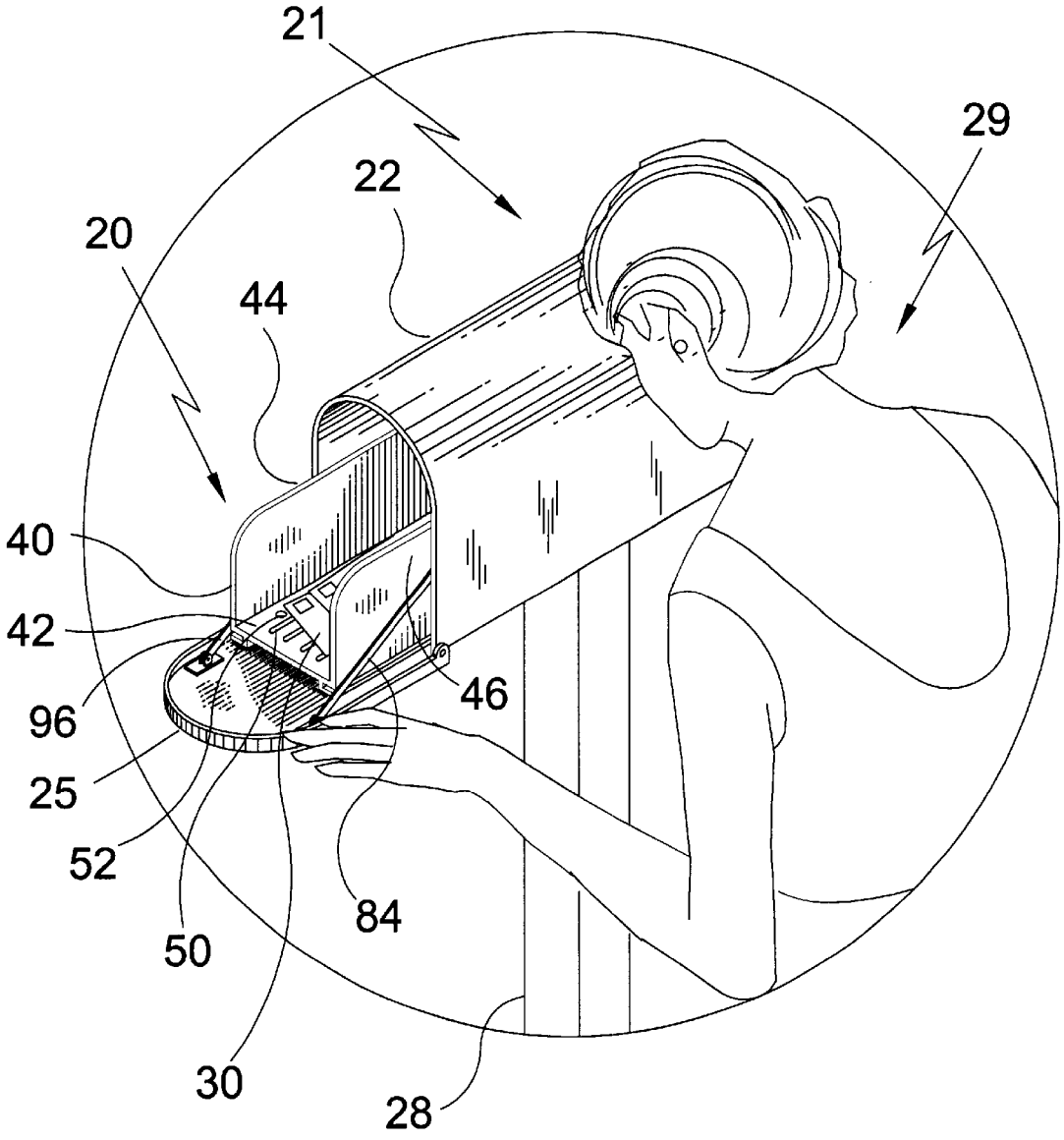
FIG. 1 is perspective view of the present invention in use; shown is a user standing beside the mailbox and opening the door to the mailbox which has in turn pulled out the slidable tray so the contents can be visually inspected and easily removed.

Turning now descriptively to the drawings, in which similar reference characters denote similar elements throughout the several views, the figures illustrate the Slidable Tray Mailbox Insert of the present invention. With regard to the reference numerals used, the following numbering is used throughout the various drawing figures.

| | |
|---|---|
| 20 | Slidable Tray Mailbox Insert of the present invention |
| 21 | mailbox |
| 22 | mailbox U-shaped portion |
| 23 | mailbox back portion |

-continued

| | |
|---|---|
| 24 | mailbox bottom portion |
| 25 | mailbox front door |
| 26 | mailbox front door hinges |
| 27 | mailbox interior |
| 28 | mailbox post |
| 29 | user |
| 30 | mail |
| 40 | tray |
| 42 | tray bottom |
| 44 | tray left wall |
| 46 | tray right wall |
| 48 | tray back panel |
| 50 | tray condensation ridges |
| 52 | tray drain holes |
| 54 | tray left track member |
| 56 | tray right track member |
| 60 | track frame |
| 62 | track frame left member |
| 64 | track frame right member |
| 66 | track frame braces |
| 68 | track adhesives |
| 70 | tray stop member |
| 72 | track frame stop member |
| 76 | left extension arm |
| 78 | left extension arm foot pad |
| 80 | left extension arm foot pad adhesive |
| 82 | left extension arm pivoting pin |
| 84 | right extension arm |
| 86 | right extension arm foot pad |
| 88 | right extension arm foot pad adhesive |
| 90 | right extension arm pivoting pin |

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1–13 illustrate the Slidable Tray Mailbox Insert device of the present invention indicated generally by the numeral 20.

The device 20 and its components are shown generally in FIGS. 1–13 and in use in FIG. 1. The device 20 is used in a typical rural-type mailbox 21 that has a U-shaped portion 22, a back portion 23, a bottom portion 24, and a front door 25 that swings open on hinges 26, to expose the interior 27. The mailbox 21 is usually positioned on a post 27 near a street for access by mail carriers in delivery vehicles. The interior 27 is deep and often causes an unnecessarily uncomfortable reach by the mail carrier, or causes the occupant/user 29 to stand in front of the mailbox 21 in order to reach mail 30 that has been pushed to the rear of the interior 27.

To alleviate the concerns of both the mail carrier and the user 29, a tray assembly 40 is provided that has a bottom 42, a left wall 44, a right wall 46, and a back panel 48, the back panel 48 being generally conformed to the U-shaped portion 22 of the mailbox 21.

Figure 2:
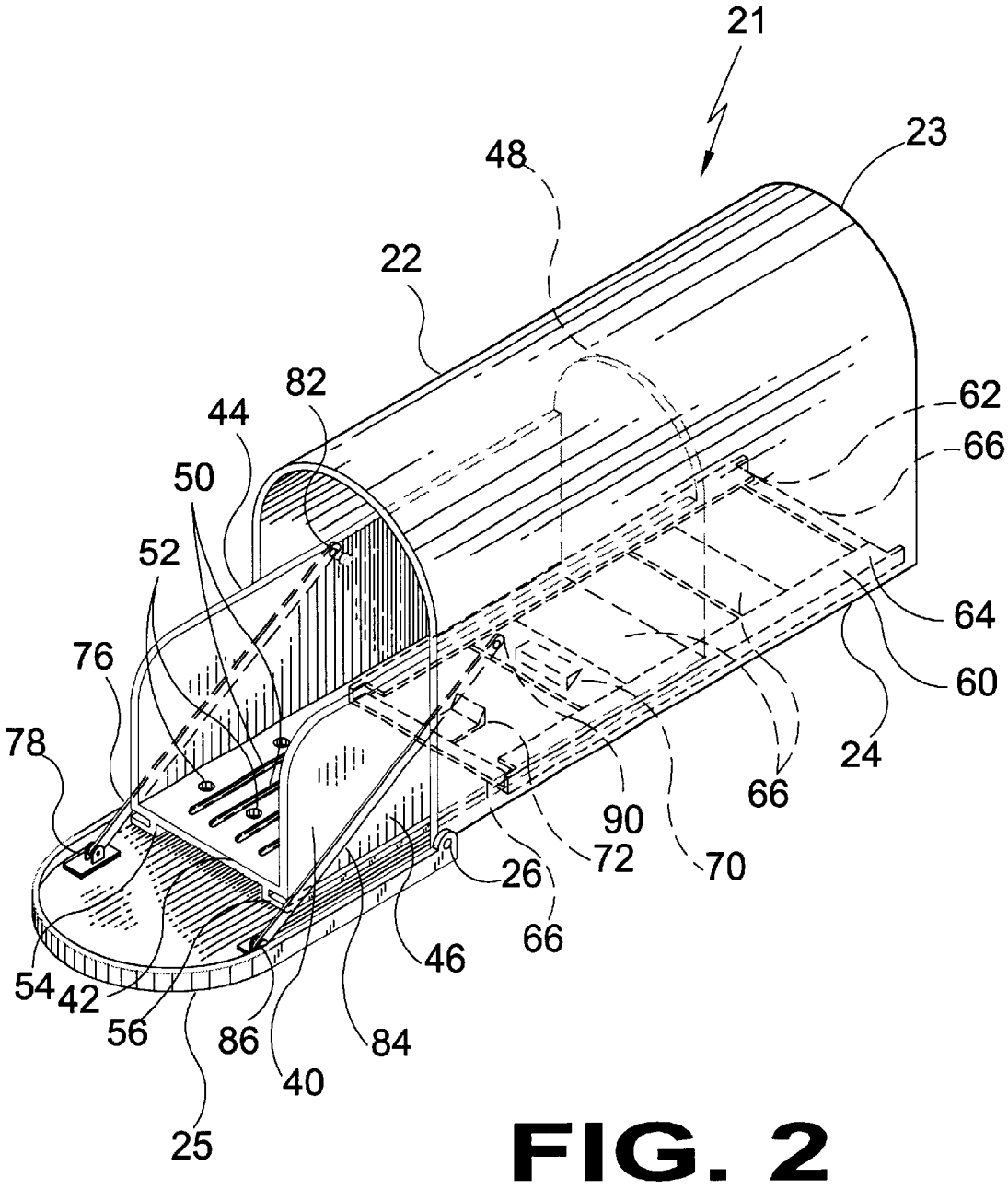
FIG. 2 is a perspective view of the present invention installed inside of a conventional roadside mailbox in the opened operational position. Shown in hidden line is the interior portion of the slidable tray and the track framework.

As shown in FIGS. 1 and 2, these features of the tray 40 form a drawer-like container for the mail 30. The tray bottom 42 has several elevated condensation ridges 50 positioned longitudinally along the length of the tray bottom 42, along with several drain holes 52. These features protect the mail 30 from condensation that can accumulate on the tray bottom 42 during ordinary use by elevating the mail 30 on the ridges 50 and allowing the involved liquids to drain through the holes 52. The shape of the tray back portion 48 reduces the likelihood that mail 30 will be displaced from the rear of the tray 40.

Figure 13:
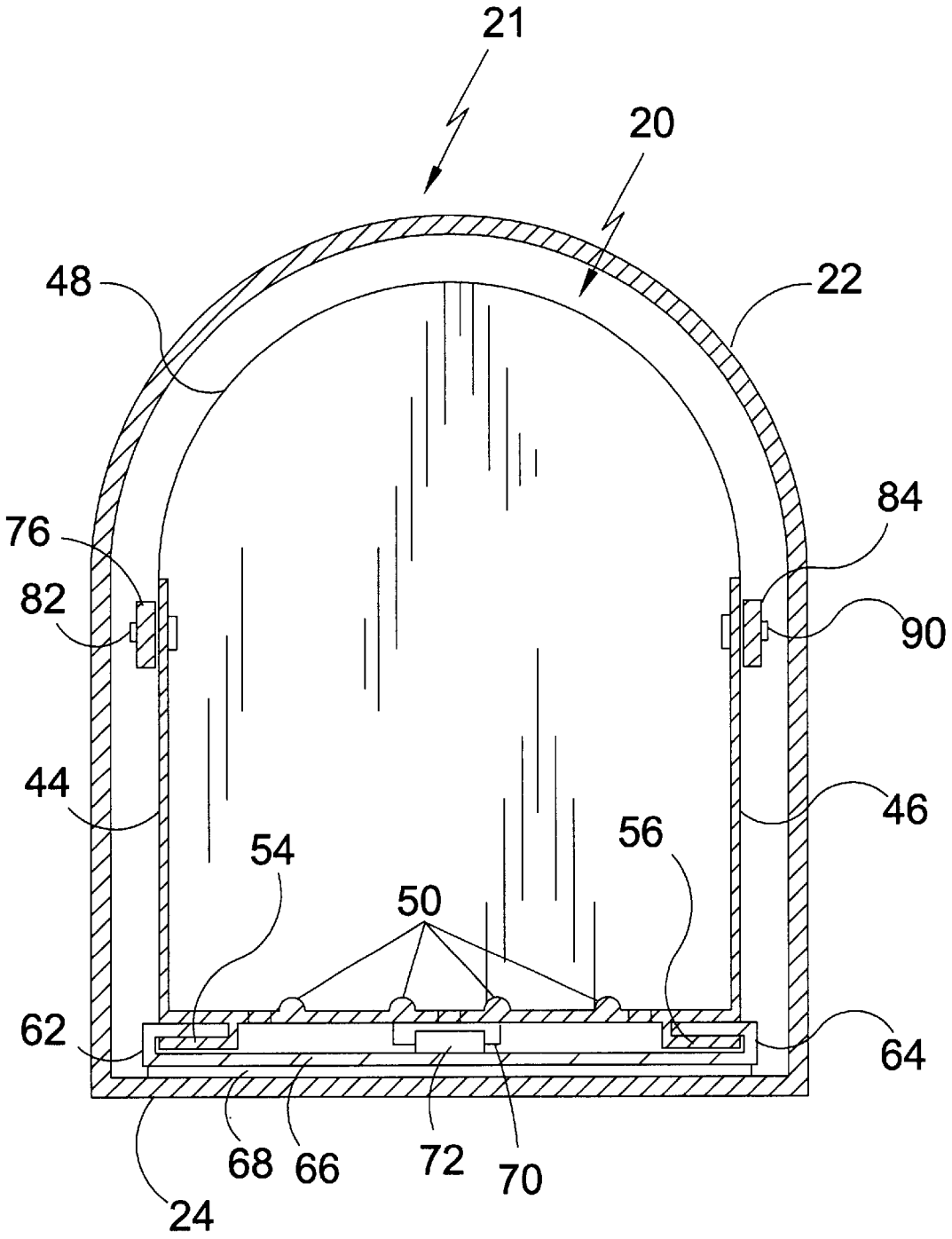
FIG. 13 is a sectional front view of the present invention installed within a mailbox.

The tray 40 also has a left track member 54 and a right track member 56, each being adapted for insertion into, and sliding along the length of, a track frame 60, that has a track frame left member 62 for receiving the tray left track member 54, and a track frame right member 64 for receiving the tray right track member 56. The mating relationship is shown in FIG. 13.

Figure 4:
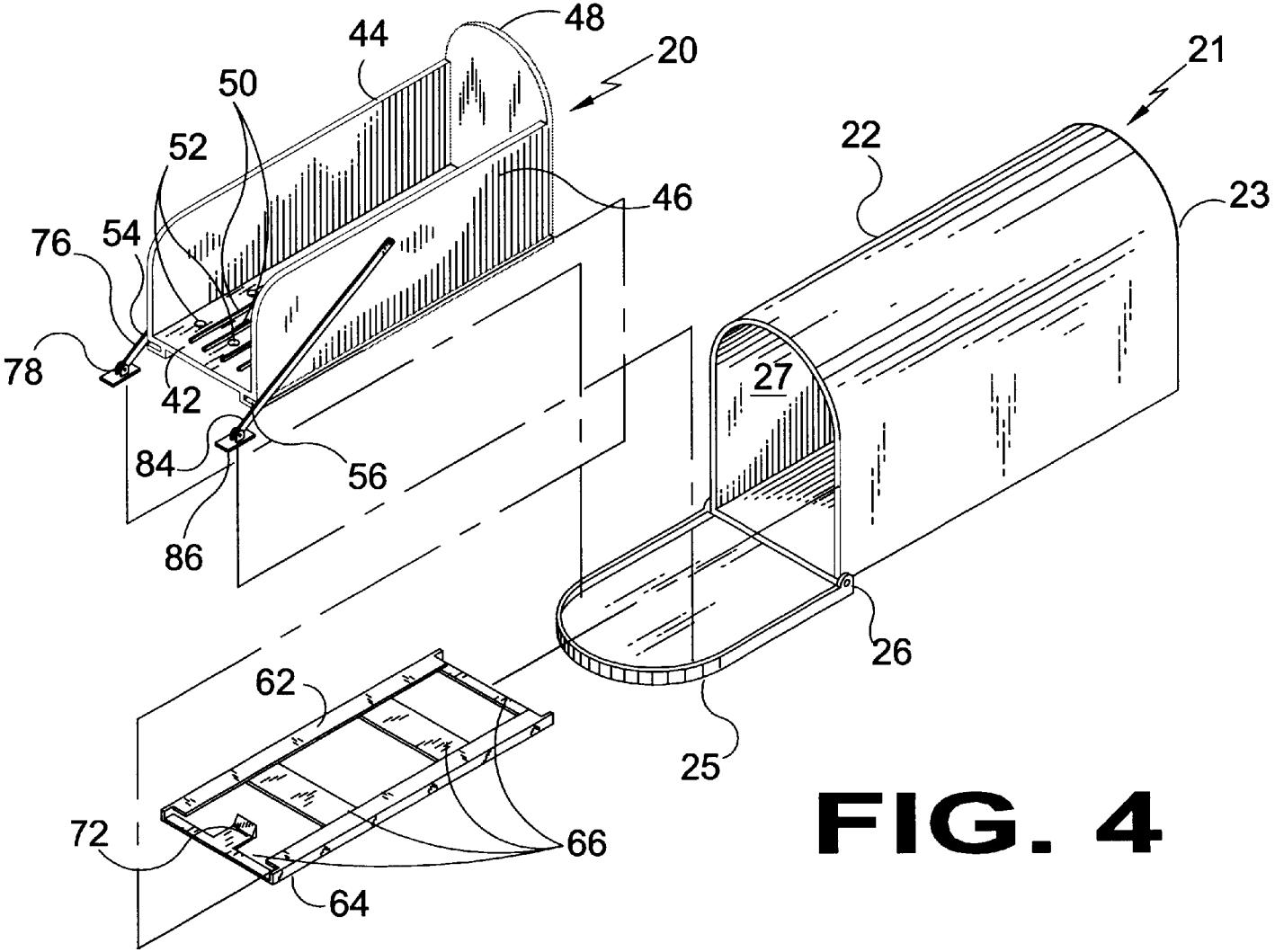
FIG. 4 is an exploded perspective view of the present invention and a conventional roadside mailbox.
Figure 5:
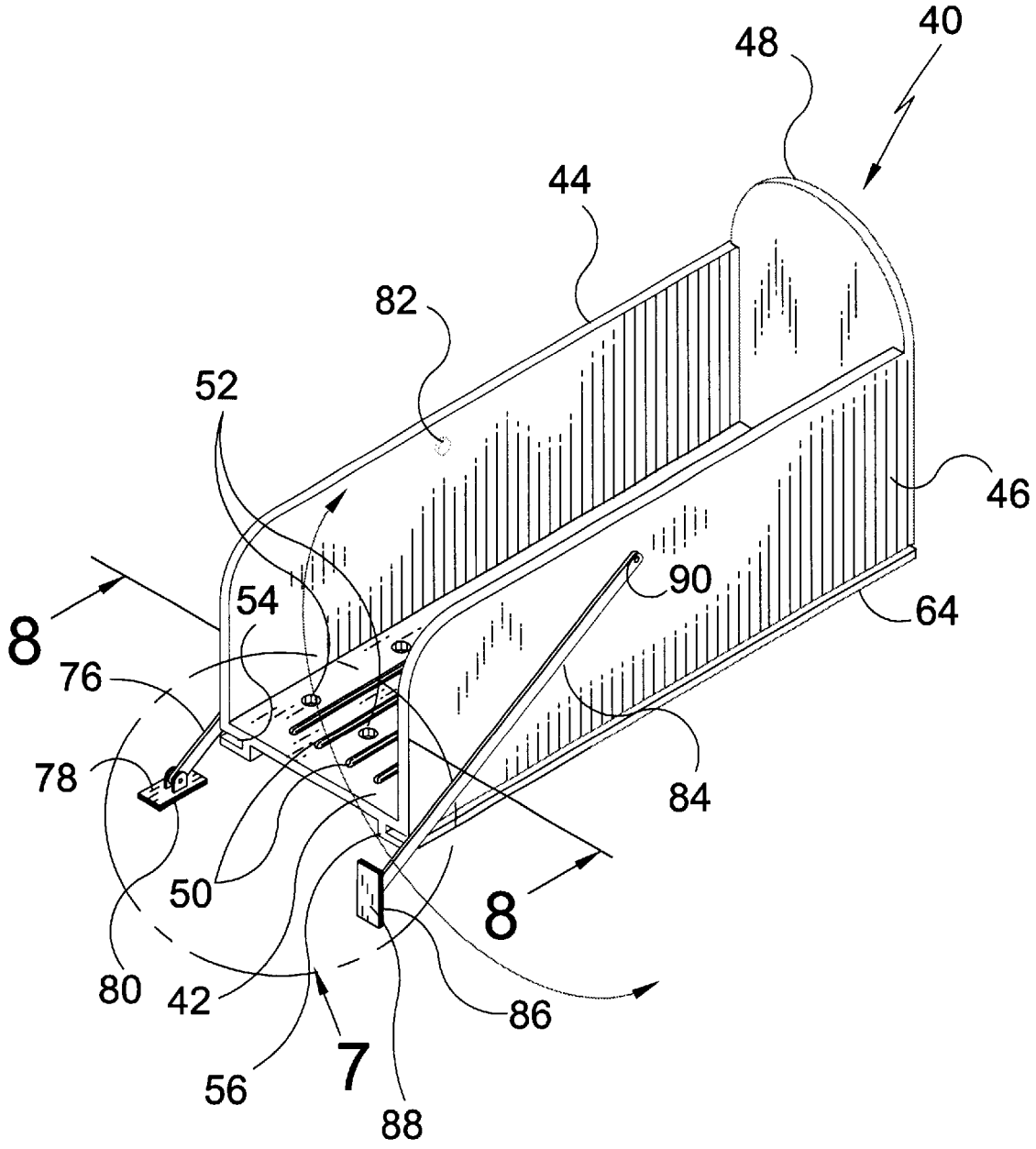
FIG. 5 is a perspective view of the slidable tray assembly.
Figure 6:
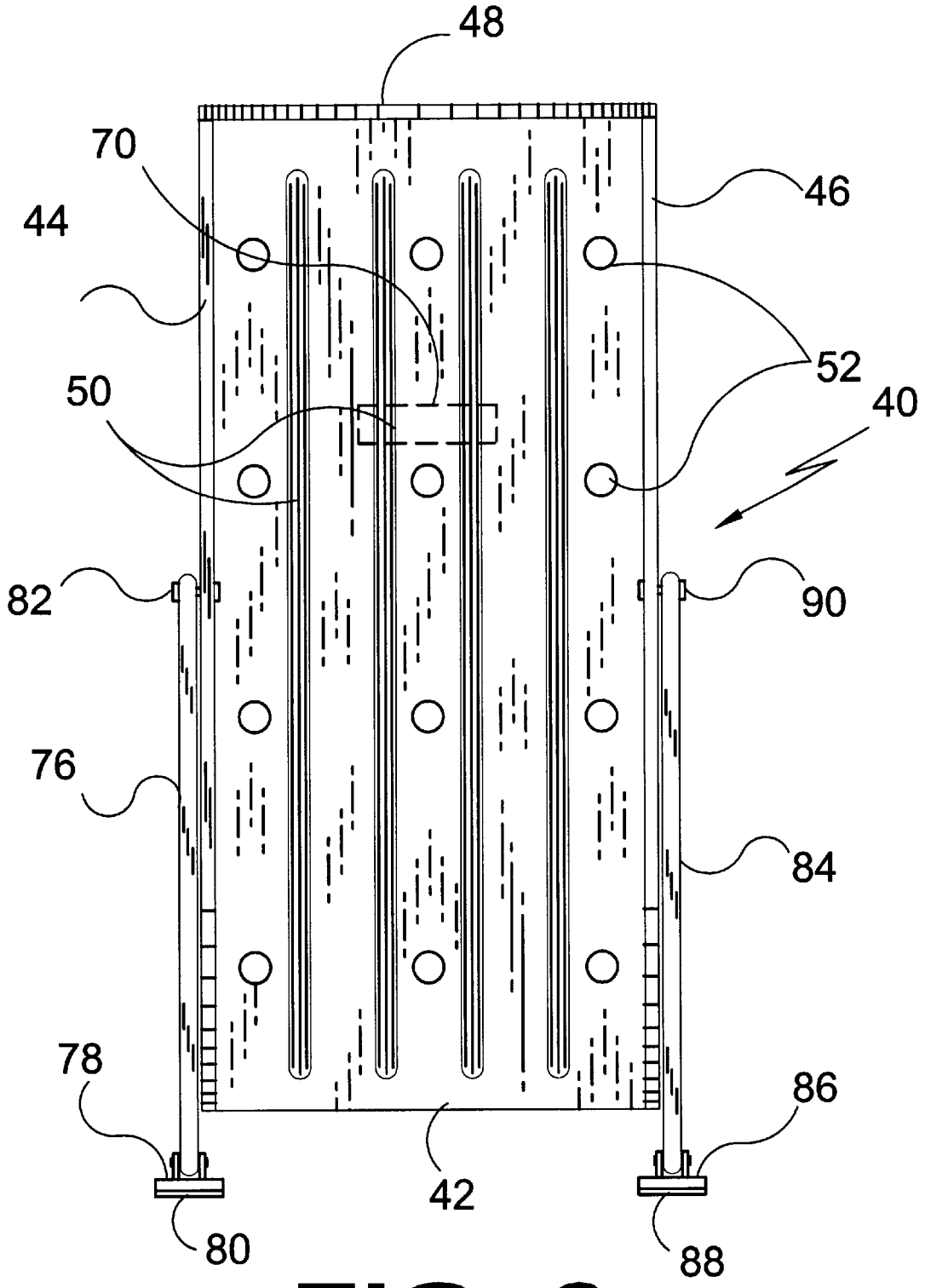
FIG. 6 is a top view of the slidable tray assembly.
Figure 7:
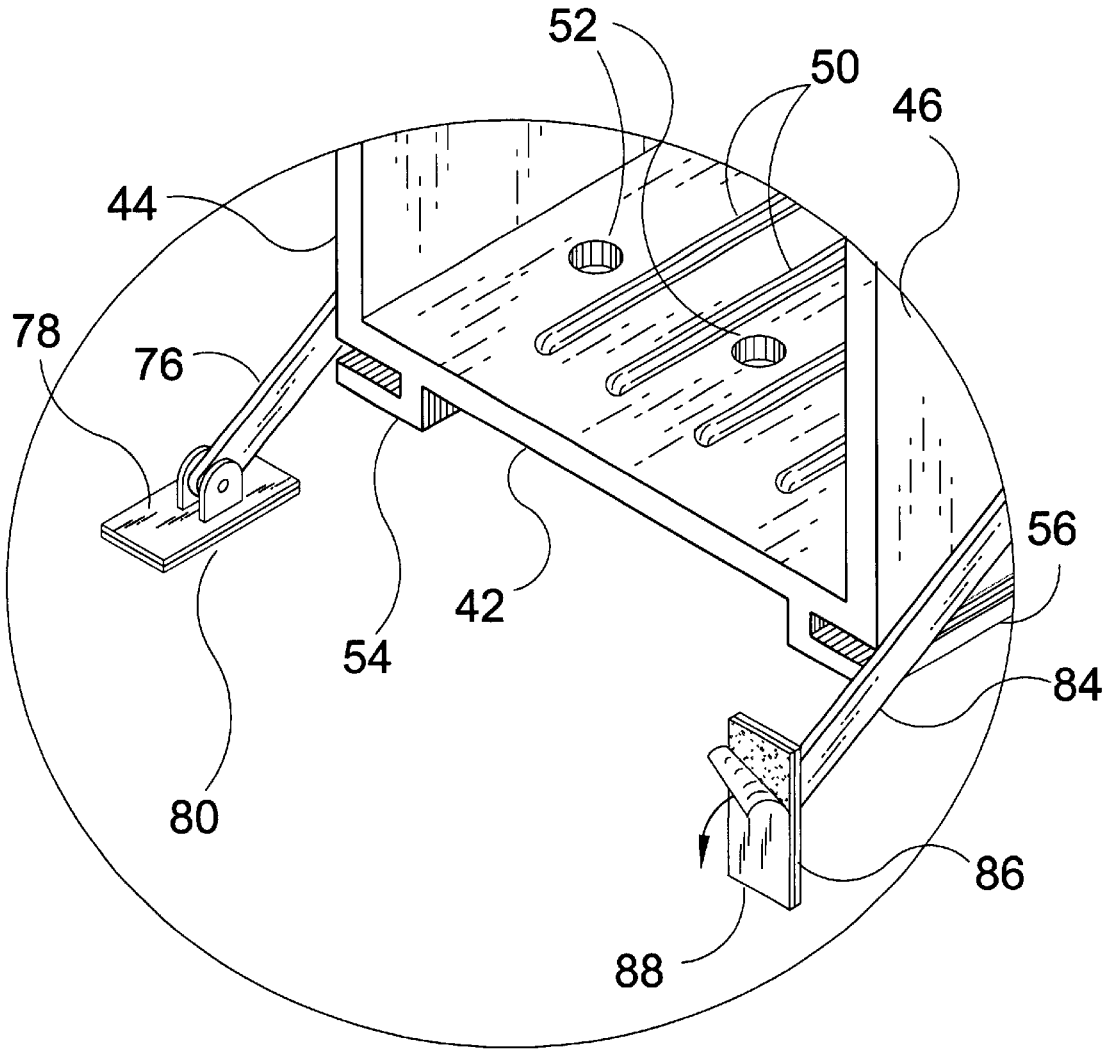
FIG. 7 is a detailed view of the tray track members and footpads of the slidable tray assembly taken from FIG. 5 as indicated.
Figure 8:
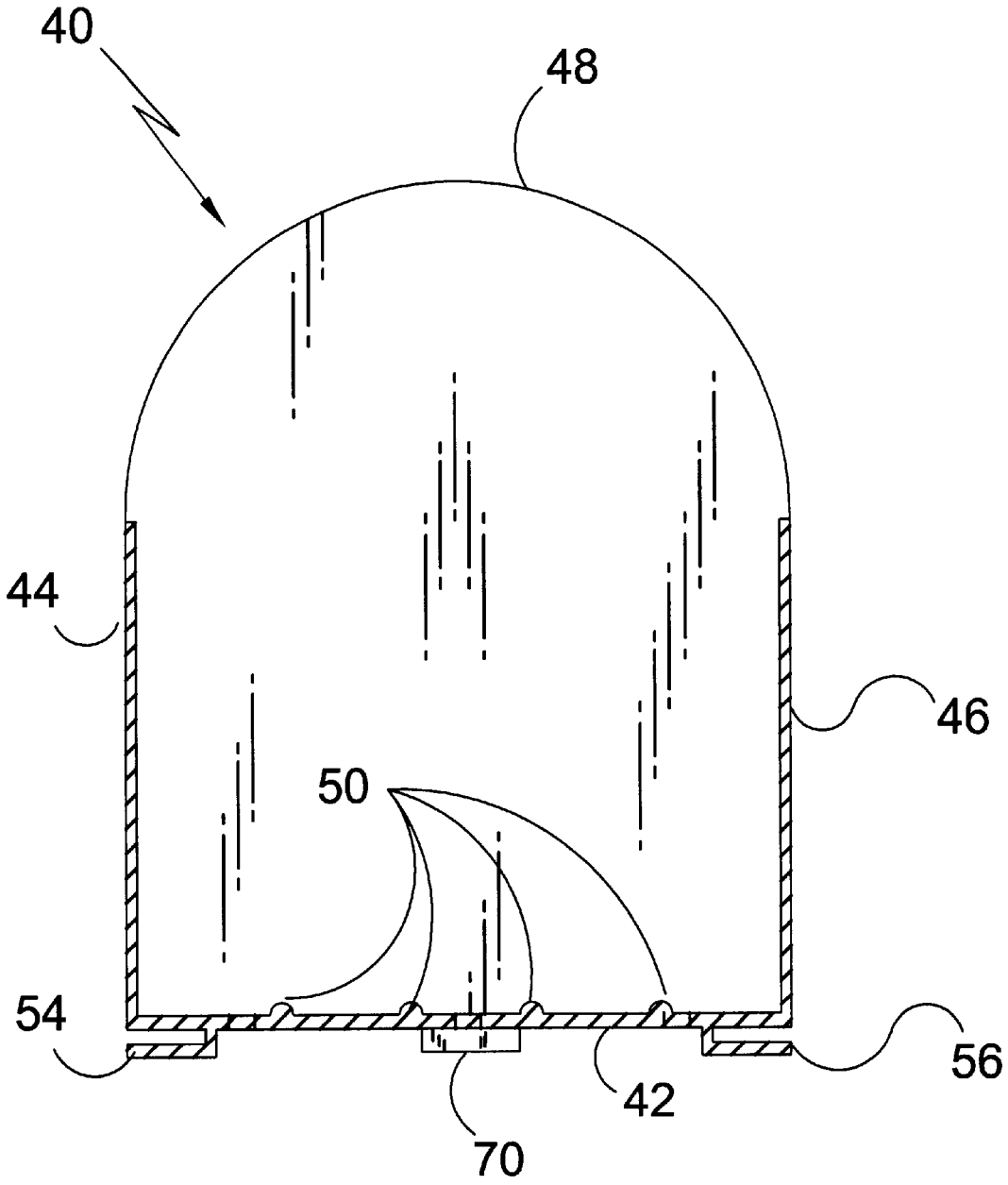
FIG. 8 is a sectional front view of the slidable tray.
Figure 9:
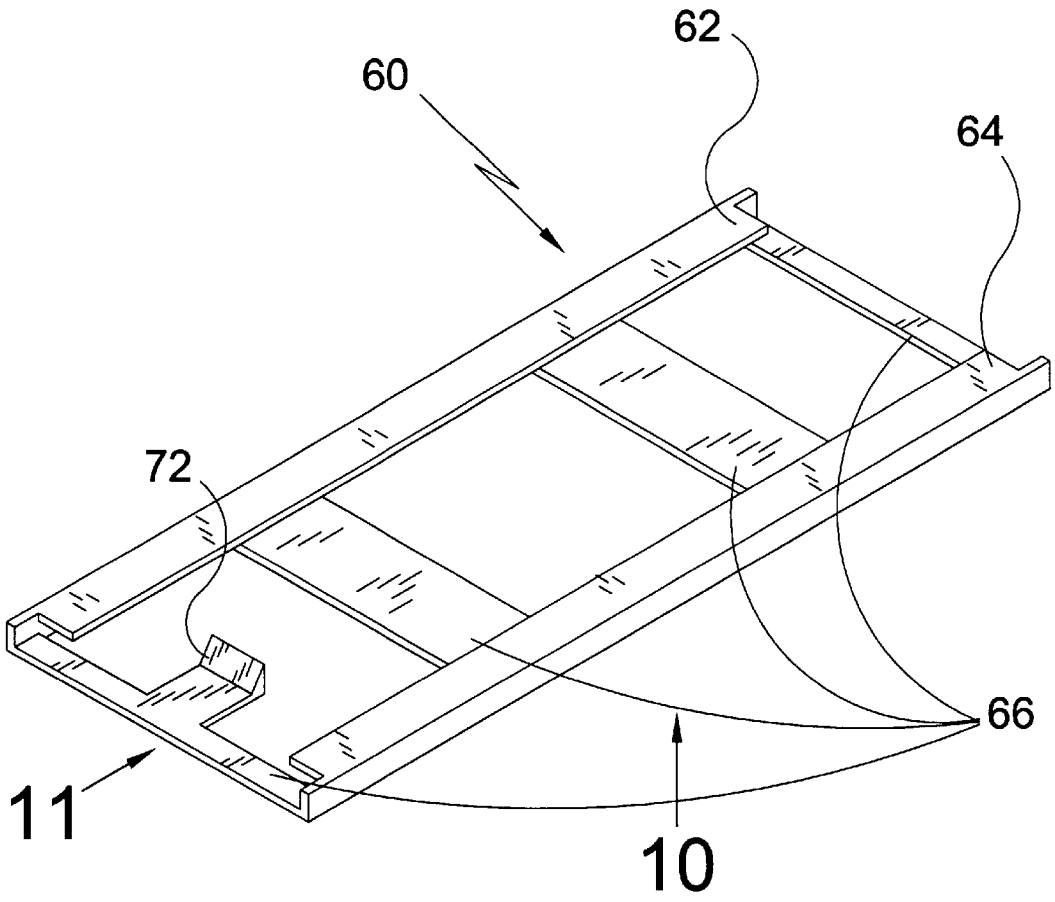
FIG. 9 is a perspective view of the track framework.
Figure 10:
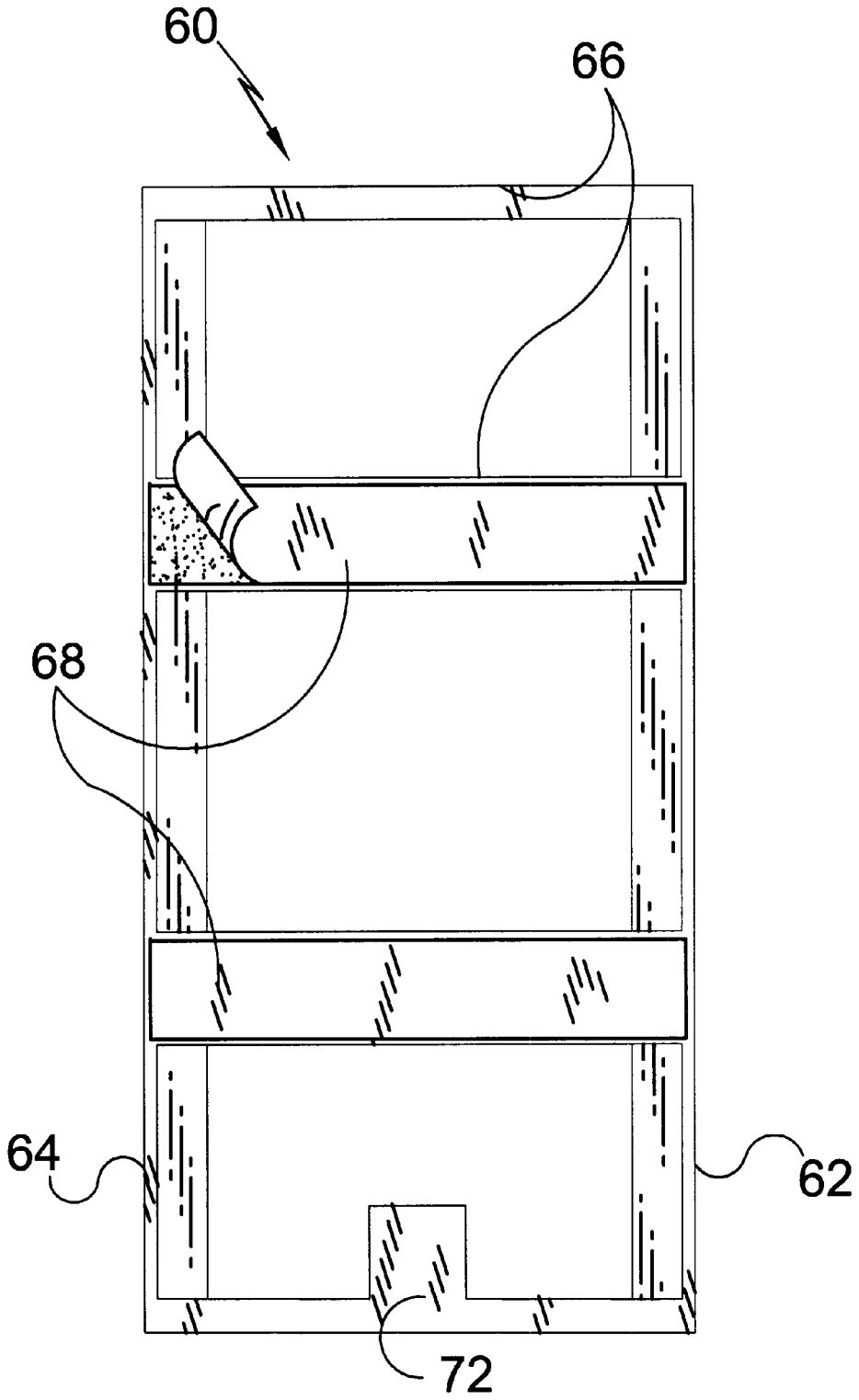
FIG. 10 is a bottom view of the track framework.
Figure 11:
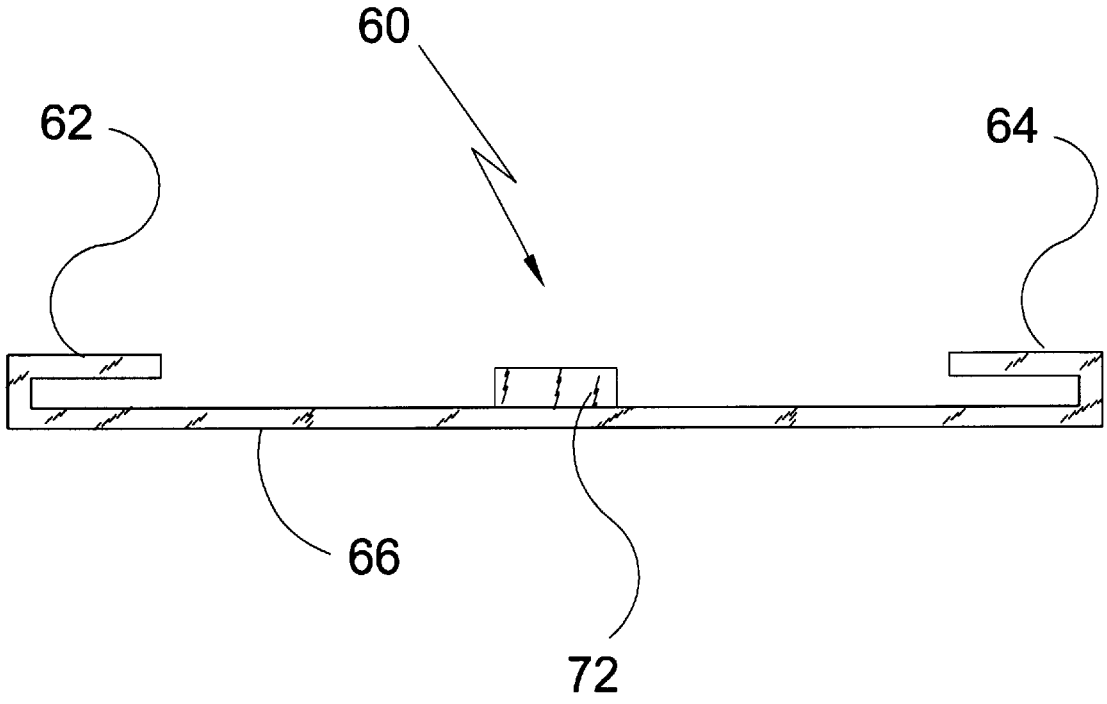
FIG. 11 is a front view of the track framework.

As shown in FIG. 4 and in FIGS. 9–10, the track frame 60 includes braces 66 and adhesive strips 68 for attachment to the mailbox bottom portion 24. The tray 40 has a stop member 70 that is positioned for encounter with a corresponding stop member 72 on the track frame 60.

FIGS. 3–7 depict a left extension arm 76 has a foot pad 78 pivotally attached to the mailbox front door 25, the foot pad 78 having an adhesive strip 80 for attachment of the foot pad 78 to the front door 25. The other end of the left extension arm 76 is pivotally attached to the tray left wall 44 by pin 82. Similarly, a right extension arm 84 has a foot pad 86 that is pivotally attached to the mailbox front door 25, the foot pad 86 being attached by an adhesive strip 88. A pin 90 is used to pivotally attach the other end of the right extension arm 84 to the tray right wall 46.

Figure 3:
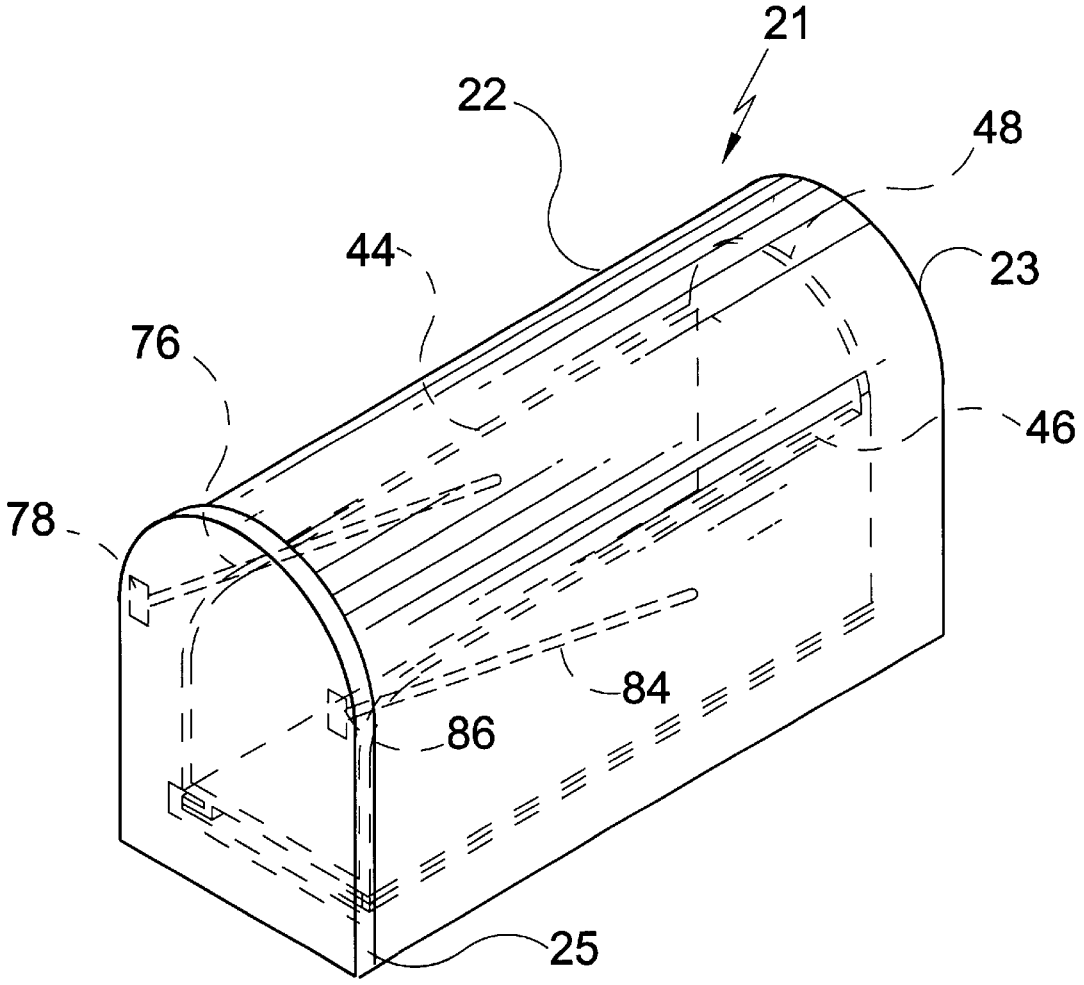
FIG. 3 is a perspective view of the present invention installed inside of a conventional roadside mailbox in the closed operational position. Shown in hidden line is the slidable tray.
Figure 12:
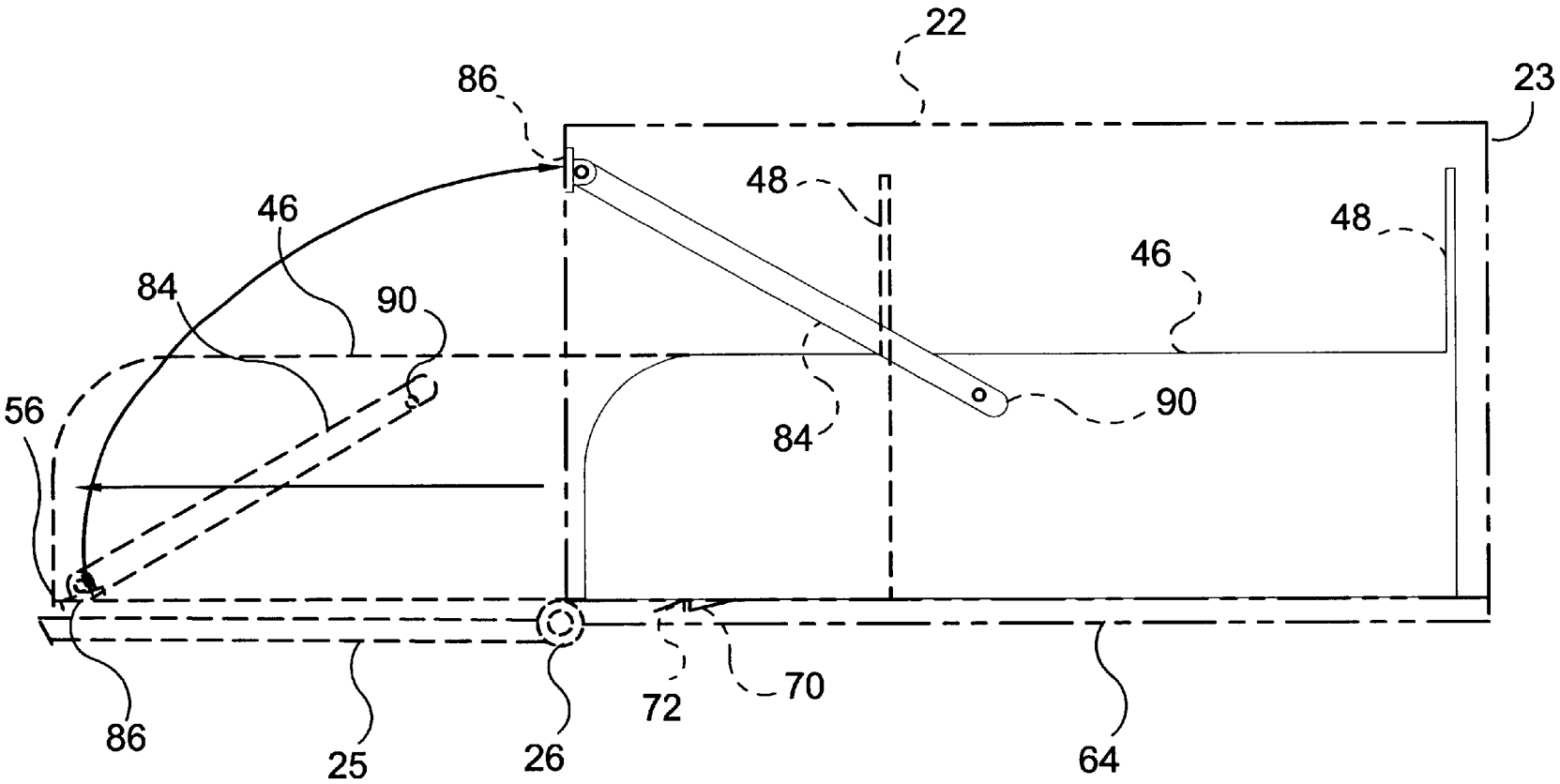
FIG. 12 is side view of the present invention inside a mailbox illustrating the movement of the slidable tray with the open position shown in hidden line.

As shown in FIGS. 2–3 and 12, the attached extension arms 76,84 are used to pull the tray 40 from the mailbox 21 as the mailbox front door 25 is opened, with the tray stop 70 and track stop 72 being joined to stop over-extension of the tray 40 that might otherwise occur if the front door 25 was allowed to swing too far downwardly. The pivotal motion of the extension arms 76,84 about pins 82,90 and about the foot pads 78,86.

Once the front door 25 is opened and stopped, the tray 40 is appropriately extended to a point outside the mailbox 21, allowing a much safer side access to the mail 30, as shown in FIG. 1.

After the mail 30 has been retrieved the user 29 closes the front door 25, which in turn moves the extension arms 76,84 against the tray walls 44,46, thus causing the tray 40 to slide rearwardly as its track members 54,56 move through the track frame members 62,64. The closed position is shown in FIGS. 3 and 12.

The device 20 and its foregoing components can be constructed using various materials, including various woods, plastics, and metals. The attachment means, such as adhesives 68,80,88 can be of numerous types, including glue-based adhesive tapes, hook and loop strips, typical screws, bolts, and the like. The track mechanism 54,56,60 can be a single track, and the tray 40 and track frame 60 can be sized for other mailbox shapes. Similarly, the materials, in various component combinations, can be chosen to accommodate mailboxes of various types and sizes, all in accordance with the present invention, and as determined by the intended end use for the overall device.

With respect to the above description then, it is to be realized that the optimum material and dimensional relationships for the parts of the device, to include variations is size, materials, shape, and form, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A device for accessing mail within a mailbox, the mailbox having a bottom panel, back panel, roof portion, and a pivoting front door, the device comprising:

a tray, the tray having a bottom portion, a pair of opposite sidewall portions, a back portion, and a pair of track members;

a pair of extension arms, each arm having a first end pivotally attached to one of the tray sidewalls, and a second end pivotally attached to the mailbox front door;

a track, the track being attached to the mailbox, the track being adapted to receive the tray track member such that the tray is slidable along the track, the tray being pulled along the track and at least partially out of the mailbox when the mailbox door is opened, the tray being pushed along the track and back within the mailbox when the mailbox door is closed; and each of the track members has an outwardly extending horizontal portion and the track has two inwardly facing slots for receiving the track member horizontal portions.

2. The device of claim 1, wherein the tracks have an abutment member and the tray has an abutment member, the two abutment members being brought to an encounter as the tray is from the mailbox, thus stopping the tray from being pulled further along the tracks.

3. The device of claim 1, wherein the tray back portion is closely received by the mailbox roof portion as the tray is pushed into the mailbox.

4. The device of claim 1, wherein the mailbox roof portion is U-shaped and the tray back portion is U-shaped for close receipt by the mailbox roof portion.

5. The device of claim 1, wherein the tray bottom portion further comprises at least two elevated ridges.

6. The device of claim 1, wherein the tray bottom portion further comprises at least one drain hole.

7. The device of claim 1, wherein the tracks are attached to the mailbox using adhesives.

8. The device of claim 1, wherein each track is attached to the mailbox using hook and loop strips.

9. The device of claim 1, wherein each track is attached to the mailbox using adhesive strips.

10. The device of claim 1, wherein each track is attached to the mailbox using magnets.

11. The device of claim 1, wherein each track is attached to the mailbox using screws.

12. The device of claim 1, wherein each track is attached to the mailbox using bolts.

13. The device of claim 1, wherein the extension arm first ends are attached to the mailbox front door using adhesives.

14. The device of claim 1, wherein the extension arm first ends are attached to the mailbox front door using hook and loop strips.

15. The device of claim 1, wherein the extension arm first ends are attached to the mailbox front door using adhesive strips.

16. The device of claim 1, wherein the extension arm first ends are attached to the mailbox front door using magnets.

17. The device of claim 1, wherein the extension arm first ends are attached to the mailbox front door using screws.

18. The device of claim 1, wherein the extension arm first ends are attached to the mailbox front door using bolts.

* * * * *